United States Patent [19]

Arbter

[11] Patent Number: 4,605,179

[45] Date of Patent: Aug. 12, 1986

[54] APPARATUS FOR WINDING UP FLAT MATERIAL WEBS

[75] Inventor: Conrad Arbter, Saal an der Saale, Fed. Rep. of Germany

[73] Assignee: Kolb & Schule AG, Fed. Rep. of Germany

[21] Appl. No.: 653,876

[22] Filed: Sep. 21, 1984

[30] Foreign Application Priority Data

Sep. 23, 1983 [DE] Fed. Rep. of Germany ..... 3334370

[51] Int. Cl.[4] ..... B65H 75/24; B65H 75/28

[52] U.S. Cl. ..... 242/72 B; 242/74; 242/74.2

[58] Field of Search ..... 242/72 B, 74, 74.1, 242/68.2, 66, 79.2, 67.1 R

[56] References Cited

U.S. PATENT DOCUMENTS

| | | | |
|---|---|---|---|
| 2,204,928 | 6/1940 | Culver | 242/74 X |
| 2,849,192 | 8/1958 | Fairchild | 242/72 B |
| 3,053,467 | 9/1962 | Gidge | 242/72 B X |
| 3,863,857 | 2/1975 | Smith | 242/72 B |
| 3,945,583 | 3/1976 | Ochs et al. | 242/72 B X |
| 3,972,488 | 8/1976 | Lee et al. | 242/72 B |
| 3,973,740 | 8/1976 | Schankler | 242/74 X |
| 4,120,464 | 10/1978 | Uritis | 242/74 X |
| 4,516,735 | 5/1985 | Snygg | 242/66 X |

FOREIGN PATENT DOCUMENTS 1264204 3/1968 Fed. Rep. of Germany .

*Primary Examiner*—Stuart S. Levy
*Assistant Examiner*—Lynn M. Sohacki
*Attorney, Agent, or Firm*—McGlew and Tuttle

[57] ABSTRACT

In an apparatus for winding up flat material webs or foils, by means of a rotary winding cylinder, the cylinder is provided with a longitudinal slot and which accommodates a clamping device and by which a portion of the web to be wound up and introduced through the slot by means of a vertically movable blade which causes the web to be seized and firmly held. Upon finishing a roll, the seized portion of the web is disengaged and the roll can be withdrawn by means of a take-off device. This makes it possible to wind up the web at a high speed without forming folds. Also, the laps of the formed roll are very firmly wound and their edges are throughout in a definite position so that they may be heated in a working station.

7 Claims, 7 Drawing Figures

APPARATUS FOR WINDING UP FLAT MATERIAL WEBS

FIELD AND BACKGROUND OF THE INVENTION

This invention relates in general to winding devices and in particular to a new and useful web material winding device for rapidly winding flat material webs or foils.

Winding cylinders for material webs, permitting the compacting of the material for easier transportation, are known in the form of metallic or hard paper winding tubes. With such tubes, one end of the web is loosely applied to the tube which is set in rotation, mostly manually, so that upon terminating the winding, the other end of the web does not come into a definite position which, for the transportation, is not required. In addition, folds form frequently during the winding and a roll thus obtained is not usable for further treatment.

SUMMARY OF THE INVENTION

The present invention is directed to an apparatus for winding sheet material which forms a roll which, in a plant or station for further treatment, not only can easily be transported from station to station, but also may undergo some treatment. More particularly, it is intended to make possible to hem or weld the edges of the wound web considering that their spacing from the winding cylinder is always exactly determinable. It is further sought to permit an easy rapid winding with no folds being formed. The removal of a roll from the winding cylinder is also made easy.

The apparatus in accordance with the invention is not only simple in construction and thus inexpensive in manufacture, but also usable in many ways, reliable in operation, and easy to handle. That is, as soon as the web to be wound is firmly fastened by means of the clamping device mounted in the winding cylinder, the winding cylinder can be driven at a high speed to form the roll in a short time without producing folds. Even a double winding may be effected, by clamping the web to be wound about centrally.

With the inventive apparatus, the material web or foil is wound very firmly. The great advantage is primarily that upon a predetermined number of complete and/or partial revolutions of the winding cylinder the edges of the web are brought into an always definite position and can thus be treated in one or more working stations. In this way due to the compacting of the material to a small space, the transportation of flat materials is considerably facilitated and guiding means as well as operating space are saved. Rolls formed with the inventive apparatus are thus usable in many ways, and they are also quickly removable from the winding cylinder, by means of the take-off device.

Accordingly it is an object of the invention to provide an improved apparatus for winding flat material webs which include a rotatable cylinder having a longitudinal slot and a clamping device arranged in the cylinder behind the slot into which the web can be introduced in an arrangement in which upon finishing of the winding of the roll, the clamp portion of the web can be released from the clamping device.

A further object of the invention is to provide a clamping device for winding web material which is simple in design, rugged in construction and economical to manufacture.

DESCRIPTION OF THE PREFERRED EMBODIMENTS

Figure 1:
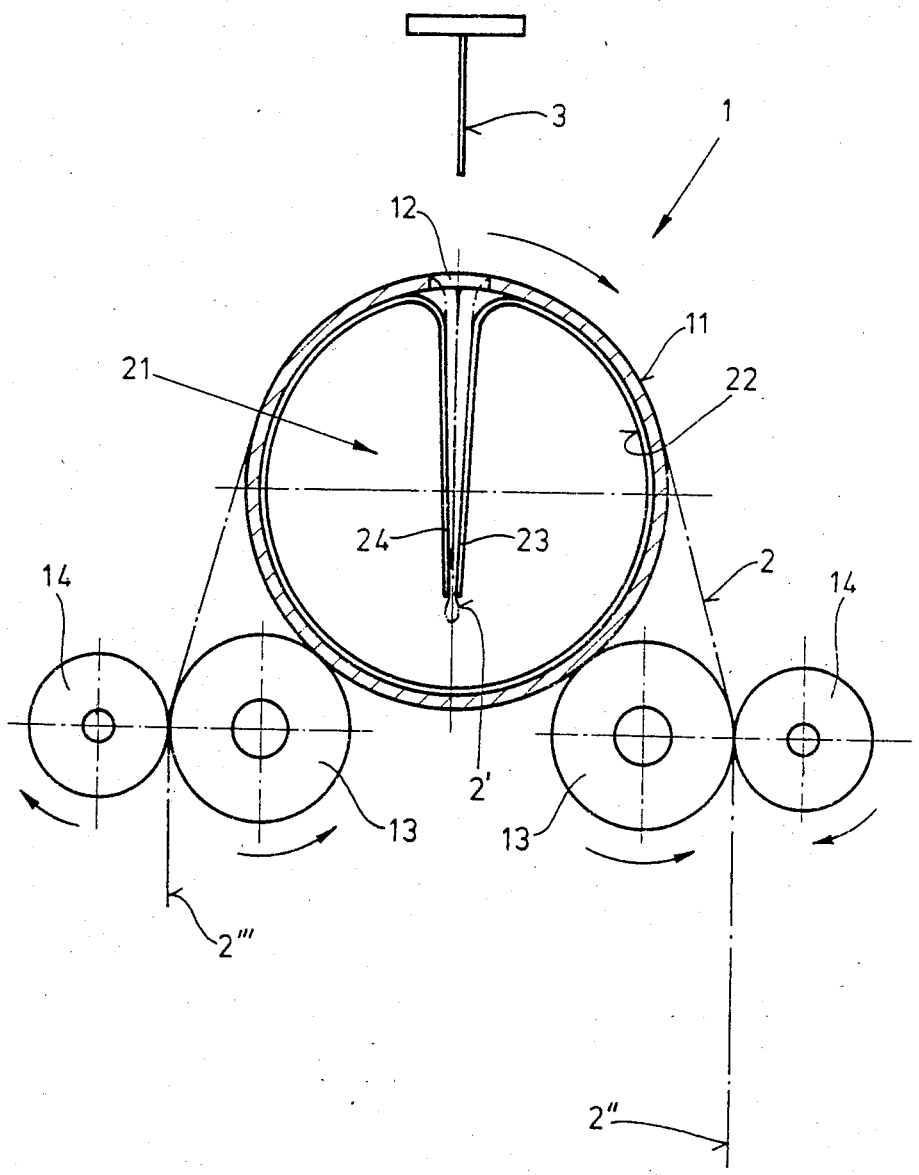
FIG. 1 is a partly sectional front view of a winding cylinder supported on back-up rollers, with a material web being fastened thereto by means of clamping device received in the cylinder.

Referring to the drawings in particular the invention embodied therein comprises an apparatus for winding flat material webs which as shown in FIG. 1 comprises the apparatus 1 employed in conjunction with a winding cylinder 11 having a longitudinally extending slot 12 defined in its surface thereof and which includes a clamping device generally designated 21 arranged in the winding cylinder behind the slot 12.

The apparatus shown in FIG. 1 comprises a winding cylinder 11 which is drivable in rotary motion, and with a clamping device 21 inserted therein with which a web 2 can be fixed to the cylinder either by its center portion 2', or by one of its end portions 2'' or 2'''. For this purpose, winding cylinder 11 is provided with a longitudinal slot 12 through which the respective portion of web 2 can be introduced into a clamping device 21 by means of a vertically movable blade 3. Winding cylinder 11 is supported by back-up rollers 13 which are associated with pressure contact rollers 14 for guiding the web 2 therebetween.

In the embodiment of FIG. 1, the clamping device 21 comprises a slotted clamping sleeve 22 which is received in the winding cylinder 11 and has angled springy arms 23, 24 projecting inwardly in the zone of the longitudinal slot 12. By means of blade 3, portion 2', or one of portions 2'', 2''', of web 2 is easily introduced between springy arms 23, 24, so that the web becomes fastened to cylinder 11 in a simple way.

Figure 2:
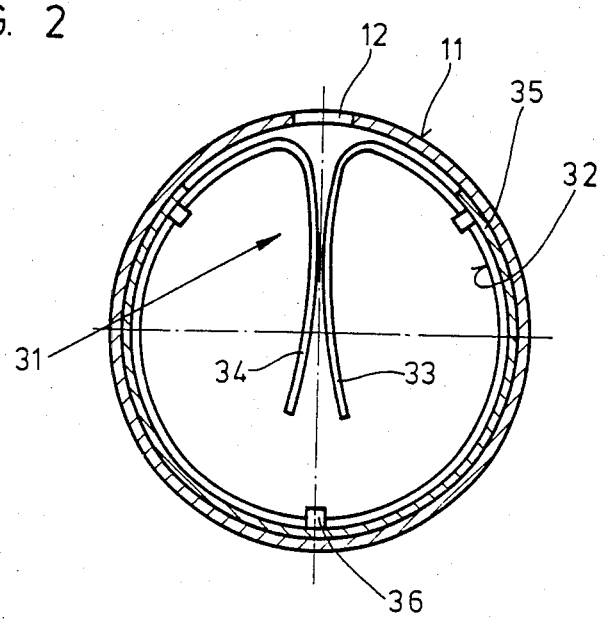
FIG. 2 to 4 are axial sectional views showing various embodiments of clamping devices usable in a winding cylinder according to FIG. 1.

According to FIG. 2, a clamping device 31 received in winding cylinder 11 comprises a plurality of laterally spaced apart spring rings 32 which also have angled springy arms 33,34 projecting inwardly in the zone of the longitudinal slot 12. Spring rings are secured by means of rivets 36 or in a similar way to a cage 35 which is connected in proper position to winding cylinder 11. Unlike the clamping device 21 where the web is clamped along its entire width, in this embodiment, the web is clamped by clamping device 31 only in its sectors engaged by springy arms 33, 34, so that if needed, the web can be withdrawn upon applying only a small force.

Figure 3:
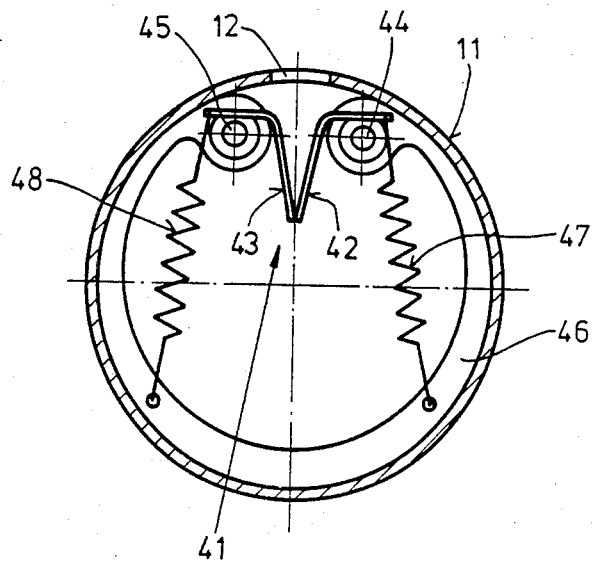

The clamping device 41 according to FIG. 3 comprises two angled clamping strips 42, 43 which are pivoted in the zone of longitudinal slot 12 by means of studs 44,45 to one or more spaced apart holding rings 46. The web portion introduced into winding cylinder 11 is squeezed and held fast by the inwardly extending arms of clamping strips 42, 43, since each of the outer arms of the strips is biased by a tension spring 47, 48 attached to holding ring 46.

Figure 4:
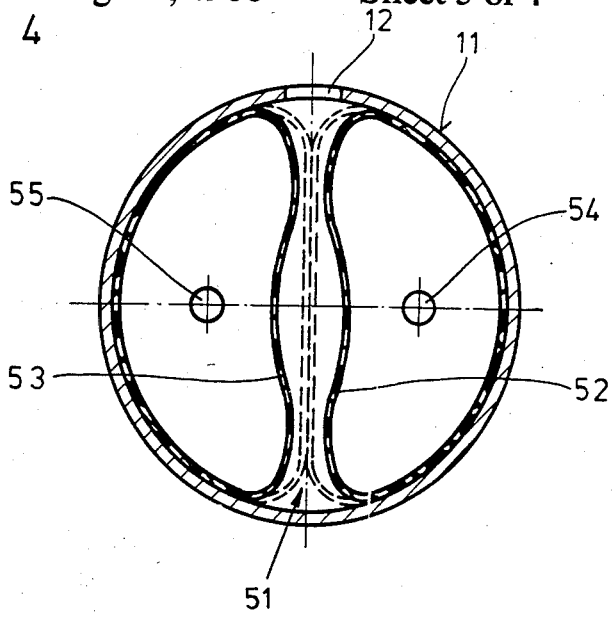
Figure 5:
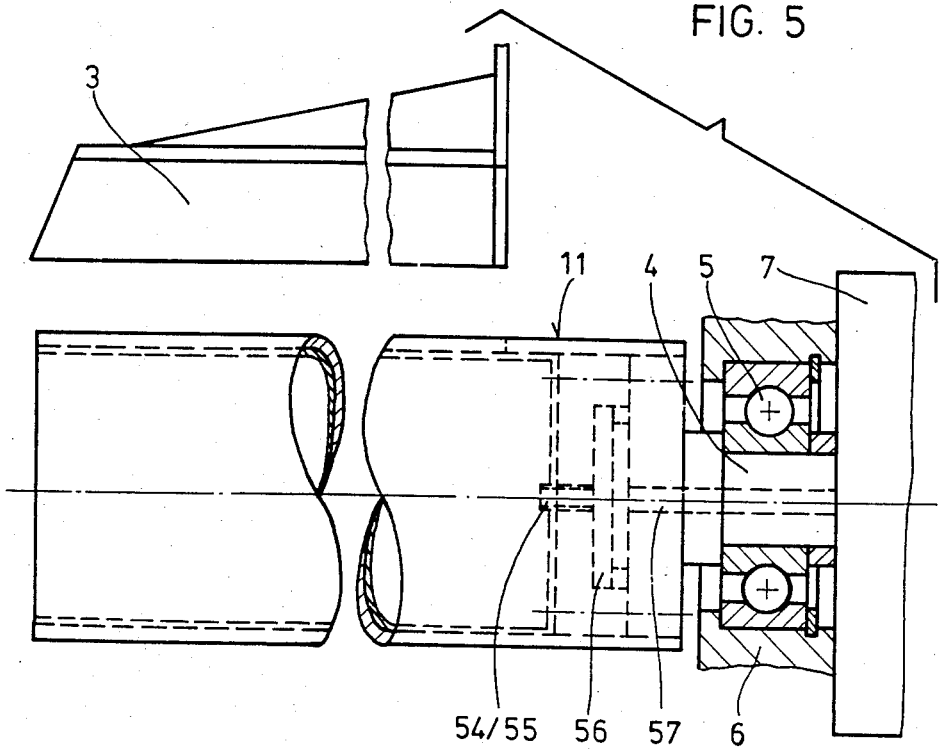
FIG. 5 is a side view of the winding cylinder equipped with a clamping device according to FIG. 4.

According to FIGS. 4 and 5, clamping device 51 comprises two inflatable flexible tubes 52, 53, one of which is inserted in winding cylinder 11 at either side of longitudinal slot 12. Flexible tubes 52, 53 can be supplied in a controllable manner with compressed air though nozzles 54,55 which are connected to a common pressure chamber 56, so that as soon as a portion of the web to be wound up is introduced therebetween, the tubes can be inflated to squeeze the web. The position after inflating tubes 52,53 is shown in FIG. 4 in broken lines.

The compressed air is supplied from a source (not shown) into pressure chamber 56 through a passage 57 which is provided in the journal 4 of winding cylinder 11. A diagramatically indicated motor 7 serves to controllably drive winding cylinder 11 which is mounted for rotation in a housing 6 through an antifriction bearing 5.

Figure 6:
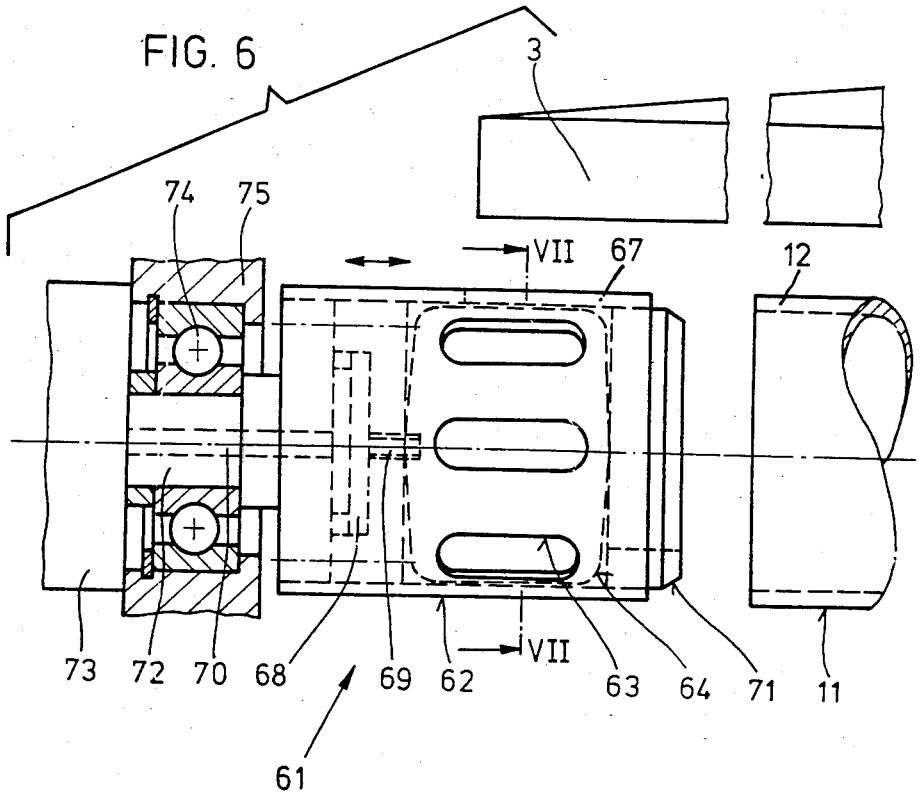
FIG. 6 is a partly sectional side view of the take-off device for removing a roll from a winding cylinder equipped according to FIG. 1.
Figure 7:
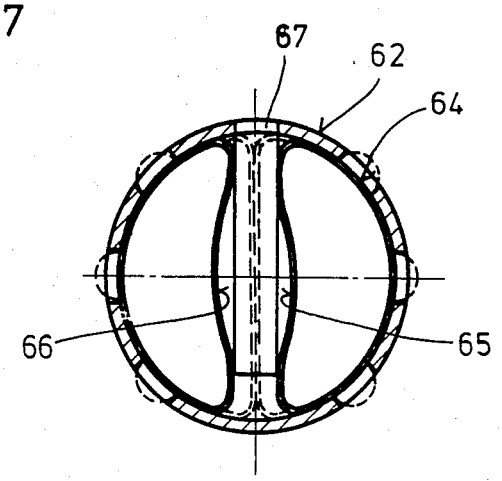
FIG. 7 is a sectional view taken along the line VII—VII of FIG. 6.

To be able to remove a roll from winding cylinder 11 quickly and safely, a take-off device 61 is provided shown in FIGS. 6 and 7 and comprising a clamping head 62 which is designed as an internal chuck. Clamping head 62 is provided with a slot 67 which is aligned with longitudinal slot 12 of winding cylinder 11. One end of blade 3 is introducible into slot 67. Inserted into spring parts as inflatable flexible tube lengths 65, 66. Clamping head 62 is further provided with oblong apertures 63 which extend in the axial direction and through which portions of flexible tubes 65,66 in inflated state can protrude upwardly, as indicated in broken lines in FIG. 7. Therefore, with tube lengths 65,66 in inflated state, clamping head 62 is tightly engaged with the roll which can then easily be withdrawn from winding cylinder 11 by axial displacement. The squeezed portion of the wound up web is loosened from the clamping device simultaneously.

To supply pressure fluid, a passage 70 is provided in a journal 72 of clamping head 62 which is mounted for rotation in a housing part 75 by means of an antifriction bearing 74 and on which winding cylinder 11 is supported by its free end through an insert 71. Passage 70 communicates with a fluid source (not shown) and the pressure fluid can be supplied therethrough into a distributor chamber 68 and therefrom through nozzles 69 to flexible tube lengths 65,66. To displace clamping head 62 axially and turn it relative to winding cylinder 11 after the removal the roll, a servo mechanism is provided which is diagrammatically indicated at 73 and by which, upon terminating a winding operation, clamping head along with the firmly engaged roll is moved first to the left, to interrupt the connection between the roll and the winding cylinder, and then turned relative thereto, to feed the roll to a working station, for example.

While specific embodiments of the invention have been shown and described in detail to illustrate the application of the principles of the invention, it will be understood that the invention may be embodied otherwise without departing from such principles.

What is claimed is:

1. An apparatus for winding flat material webs, comprising a rotatable winding cylinder having a longitudinally extending slot in the surface thereof and an open end, a clamping device arranged within said cylinder behind the slot, the web being guided over the winding cylinder and being deflectable into the slot, said clamping device including means for engaging a deflected loop of the web and holding it within the winding cylinder, said clamping device permitting release of the web after the winding is effected, a blade movable over the winding cylinder and engageable in the slot to deflect a loop of the web material into engagement with the clamping device, said clamping device including resilient means engaging the loop of web material deflected through the slot on each side thereof, a back-up roller on each side of said winding cylinder supporting said winding cylinder for rotation, contact pressure roller means on each side of said back-up rollers, and a take-off device associated with said winding cylinder mounted alongside said winding cylinder at one end thereof, said take-off device comprises an axially displaceable clamping head which is introducible into the open end of said winding cylinder and which is braced against the interior of said winding cylinder in the manner of an internal chuck, said clamping head having a slot for receiving said blade, said blade having a blade portion enterable through the slot of said clamping head, said clamping head having an insert which comprises two inflatable parts arranged at respective sides of the slot of said clamping head, and a fluid pressure supply line connected to said inflatable parts for inflating them.

2. An apparatus according to claim 1, wherein said clamping devices comprises a slotted clamping sleeve inserted in said winding cylinder and having inwardly angled first and second opposed spring arms which bias said arms together in the zone of the slot and including a blade engageable with the web wound on the winding cylinder to deflect a loop thereof into the slot and into engagement with said arms.

3. An apparatus according to claim 1, wherein said clamping device is formed by a plurality of split rings which are held together in a cage formation within said winding cylinder and have arm portions which are angled inwardly in the zone of the longitudinal slot and between which a portion of the web to be wound up is introduced.

4. An apparatus according to claim 1, wherein said clamping device comprises two angled clamping strips which are mounted for pivoting movement within said cylinder and pressed against each other by spring means connected to said clamping strips to press said clamping strips together.

5. An apparatus according to claim 1, wherein said clamping device comprises two flexible tubes insertible into the winding cylinder on either side of the longitudinal slot, and means for inflating said tubes so as to cause them to engage with the web of material through the slot.

6. An apparatus according to claim 1, wherein said clamping head has a plurality of axial oblong apertures, said inflatable flexible tubes are deformable by fluid pressure inserted within said head and protruding through the apertures to the outside, said tube being inflatable to protrude through the aperture to engage said winding rolls.

7. An apparatus according to claim 6, wherein said clamping device comprises two flexible tubes disposed in said winding cylinder on opposite sides of said longitudinal slot, and means for inflating said tubes so as to cause them to engage with the web of material extending through the slot.

* * * * *